US008818008B2

(12) United States Patent
Kim

(10) Patent No.: US 8,818,008 B2
(45) Date of Patent: Aug. 26, 2014

(54) DISPLAY APPARATUS AND CONTROL METHOD THEREOF

(75) Inventor: Young-chan Kim, Uiwang-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 1461 days.

(21) Appl. No.: 11/430,082

(22) Filed: May 9, 2006

(65) Prior Publication Data

US 2007/0009119 A1 Jan. 11, 2007

(30) Foreign Application Priority Data

Jun. 14, 2005 (KR) ..... 10-2005-50756

(51) Int. Cl.
*H04R 5/02* (2006.01)

(52) U.S. Cl.
CPC ..... *H04R 5/02* (2013.01)
USPC ..... 381/306; 381/56

(58) Field of Classification Search
CPC ..... H04R 5/02; H04R 1/02; H04N 5/642
USPC ..... 381/1–4, 11, 123, 74, 59, 56, 306, 309, 381/388; 348/715, 738, 469, 484; 455/569.2, 227, 228
See application file for complete search history.

(56) References Cited

U.S. PATENT DOCUMENTS 5,646,699 A * 7/1997 Oh et al. ..... 348/553
6,069,960 A * 5/2000 Mizukami et al. ..... 381/74
6,163,711 A * 12/2000 Juntunen et al. ..... 455/557
6,965,787 B2 * 11/2005 Kindo et al. ..... 455/569.2
7,146,013 B1 * 12/2006 Saito et al. ..... 381/92
7,298,419 B2 * 11/2007 Kaminosono ..... 348/552
2007/0133812 A1 * 6/2007 Yoshizawa et al. ..... 381/27

FOREIGN PATENT DOCUMENTS

| | | |
|---|---|---|
| CN | 1358022 | 7/2002 |
| CN | 1493169 | 4/2004 |
| CN | 1805528 | 7/2006 |
| JP | 2002-374586 | 12/2002 |
| KR | 1998-4005 | 3/1998 |
| KR | 10-2000-0014832 A | 3/2000 |
| KR | 2001-36887 | 5/2001 |
| KR | 10-2004-0066367 | 7/2004 |
| WO | 02/082858 | 10/2002 |
| WO | 03/085953 | 10/2003 |

OTHER PUBLICATIONS

KR Office Action dated Oct. 20, 2006 issued in KR 2005-50756.

(Continued)

*Primary Examiner* — Lun-See Lao
(74) *Attorney, Agent, or Firm* — Stanzione & Kim, LLP

(57) ABSTRACT

A display apparatus includes a display part to display an image thereon, a speaker to output sound, an audio input part to receive an audio signal, an audio signal processor to process the audio signal input from the audio input part through the speaker and to output the audio signal, a control signal output part to output a predetermined control signal, a detector to detect whether the audio signal is input through the audio input part, and a controller to control the audio signal processor to control the audio signal according to the control signal from the control signal output part if the audio signal is input by the detector, and to control display conditions of the image displayed on the display part according to the control signal from the control signal output part if the control signal is not input by the detector.

8 Claims, 9 Drawing Sheets

(56) References Cited

OTHER PUBLICATIONS

Chinese Office Action dated Nov. 9, 2007 issued in CN 2006100917919.

Chinese Letters Patent issued Jul. 15, 2009 in CN Patent No. 200610091791.9.

* cited by examiner

DISPLAY APPARATUS AND CONTROL METHOD THEREOF

CROSS-REFERENCE TO RELATED APPLICATIONS

This application claims the benefit of Korean Patent Application No. 2005-50756, filed on Jun. 14, 2005, in the Korean Intellectual Property Office, the disclosure of which is incorporated herein by reference.

BACKGROUND OF THE INVENTION

1. Field of the Invention

The present general inventive concept relates to a display apparatus and a control method thereof, and more particularly, to a display apparatus and a control method thereof that changes a function of a control signal output part according to whether an external device is connected to an audio input part, thereby reducing power consumption.

2. Description of the Related Art

Generally, a display apparatus processes a video signal which is received from an external device to display the received video signal thereon as an image. The display apparatus comprises a monitor which is connected to a computer and displays the video signal received from the computer as the image, and a TV which displays a broadcast signal as the image.

Recently, a monitor which is mounted with a speaker has been released. The monitor having the speaker mounted thereto comprises an audio input terminal to receive an audio signal from an outside of the monitor, (e.g. to receive an audio signal from a computer) and an audio signal processor (such as an amplifier) to output the audio signal input from the audio input terminal as sound through the speaker. Thus, the audio output terminal of the computer and the audio input terminal of the monitor may be connected to each other through an audio cable to output the audio signal output from the computer through the speaker provided in the monitor.

Also, a volume control button may be provided on an outside of the monitor having the speaker therein to control a volume of the speaker. Thus, a user may control the volume of the speaker by controlling the volume control button of the monitor as well as controlling the volume through the computer itself.

In a conventional monitor having the speaker therein, the monitor does not have a structure therein to generate the audio signal. Thus, the conventional monitor uses the speaker and the audio signal processor only when the audio input terminal is connected with an external device such as the computer.

However, if the user does not use the speaker provided in the monitor (e.g. if the audio input terminal of the monitor is not connected with the external device), the volume control button provided in the monitor to control the volume of the speaker is of no use.

Also, the audio signal processor receives power even if the speaker of the monitor is not used so that power is consumed unnecessarily.

Accordingly, it would be preferable if the volume control button could be used for other purposes when the user does not use the speaker provided in the monitor, thereby reducing the number of buttons provided on an outside of the monitor.

SUMMARY OF THE INVENTION

The present general inventive concept provides a display apparatus and a control method thereof that changes a function of a control signal output from a control signal output part of the display apparatus according to whether an external device is connected to an audio input part of the display apparatus.

The present general inventive concept also provides a display apparatus and a control method thereof that turns on and off an audio signal processor according to whether an external device is connected to an audio input part of the display apparatus.

Additional aspects and/or advantages of the present general inventive concept will be set forth in part in the description which follows and, in part, will be obvious from the description, or may be learned by practice of the present general inventive concept.

The foregoing and/or other aspects of the present general inventive concept may be achieved by providing a display apparatus comprising a display part to display an image thereon, a speaker to output sound, an audio input part to receive an audio signal, an audio signal processor to process the audio signal input from the audio input part through the speaker and to output the audio signal, a control signal output part to output a predetermined control signal, a detector to detect whether the audio signal is input through the audio input part, and a controller to control the audio signal processor to control the audio signal according to the predetermined control signal if the detector detects that the audio signal is input, and to control display conditions of the image displayed on the display part according to the predetermined control signal if the detector detects that the control signal is not input.

The detector may comprise a connection detector to detect whether an external device is connected to the audio input part.

The controller may control the audio signal processor to control a volume of the speaker according to the predetermined control signal if a connection of the external device is detected by the connection detector, and controls the display conditions of the image displayed on the display part according to the predetermined control signal if the connection of the external device is not detected by the connection detector.

The controller may control a brightness level of the image displayed on the display part according to the predetermined control signal if the connection of the external device is not detected by the connection detector.

The display apparatus may further comprise a video signal processor to process a video signal input from an external device, wherein the controller controls the video signal processor to control the display conditions of the image displayed on the display part if the connection of the external device is not detected by the connection detector.

The audio input part may comprise an audio input terminal into which an audio output jack of the external device is insertable, and the connection detector detects whether the external device is connected according to whether the audio output jack is inserted into the audio input terminal.

The display apparatus may further comprise a power supply to supply power to the audio signal processor; and a power switch to be switched on to supply the power to the audio signal processor from the power supply if the connection of the external device is detected by the connection detector, and to be switched off to cut off the power supplied to the audio signal processor from the power supply if the connection of the external device is not detected by the connection detector.

The controller may control the power switch to turn on and off the audio signal processor according to a determination of whether the connection of the external device is detected by the connection detector.

The controller may supply the power to the audio signal processor if the connection of the external device is detected by the connection detector, and cuts off the power supplied to connection detector.

The foregoing and/or other aspects of the present general inventive concept may also be achieved by providing a display apparatus comprising a display part to display an image thereon, a speaker to output sound, an audio input part to receive an audio signal, an audio signal processor to output the audio signal input from the audio input part through the speaker, a detector to detect whether the audio signal is input from the audio input part, and an audio power manager to supply power to the audio signal processor if the detector detects that the audio signal is input, and to cut off the power supplied to the audio signal processor if the detector detects that the audio signal is not input.

According to another aspect of the present general inventive concept, the detector comprises a connection detector to detect whether an external device is connected to the audio input part.

The audio power manager may supply the power to the audio signal processor if a connection of the external device is detected by the connection detector, and cuts off the power supplied to the audio signal processor if the connection of the external device is not detected by the connection detector.

The audio input part may comprise an audio input terminal into which an audio output jack of the external device is insertable, and the connection detector detects whether the external device is connected according to whether the audio output jack is inserted into the audio input terminal.

The audio power manager may comprise a power supply to supply the power to the audio signal processor and a power switch to be switched on to supply the power to the audio signal processor from the power supply if the connection of the external device is detected by the connection detector, and to be switched off to cut off the power supplied to the audio signal processor from the power supply if the connection of the external device is not detected by the connection detector.

The display apparatus may further comprise a control signal output part to output a predetermined control signal; and a controller to control a volume of the speaker according to the predetermined control signal if the connection of the external device is detected by the connection detector, and to control display conditions of the image displayed on the display part according to the predetermined control signal if the connection of the external device is not detected by the connection detector.

The controller may control the power switch to turn on and off the audio signal processor according to whether the connection of the external device is detected by the connection detector.

The foregoing and/or other aspects of the present general inventive concept may also be achieved by providing a method of controlling a display apparatus, the display apparatus having a display part to display an image thereon, a speaker to output sound, an audio input part to receive an audio signal, an audio signal processor to output the audio signal input from the audio input part through the speaker, and a control signal output part to output a predetermined control signal, the method comprising detecting whether an external device is connected to the audio input part; controlling a volume of the speaker according to the predetermined control signal if the external device is detected to be connected to the audio input part; and controlling display conditions of the image displayed on the display part according to the predetermined control signal if the external device is not detected to be connected to the audio input part.

The controlling the display conditions of the image displayed on the display part may comprise controlling a brightness of the image displayed on the display part according to the control signal from the control signal output part.

The method may further comprise supplying power to the audio signal processor if detected that the external device is connected to the audio input part; and cutting off power supplied to the audio signal processor if the external device is not detected to be connected to the audio input part.

The foregoing and/or other aspects of the present general inventive concept may also be achieved by providing a display apparatus, including an audio unit to generate sound, a display part to display an image, and a controller to output a first control signal when an external device is connected to the display apparatus to control a characteristic of the sound, and to output a second control signal when the external device is not connected to the display apparatus to control a characteristic of the displayed image. The controller may control at least one of a volume, a bass, a treble, a pitch, and an amplification of the sound output by the audio unit according to the first control signal, and the controller controls at least one of a vertical frequency, a resolution, a picture ratio, and a brightness of an image displayed on the display part according to the second control signal. The display apparatus may further include a detector unit to detect whether the display apparatus is connected to an external device, and the controller may generate the first control signal and the second control signal according to the detection operation of the detector unit. The controller may output the first control signal when the detector unit detects that the apparatus is connected to the external device, and the controller may output the second control signal when the detector does not detect that the apparatus is connected to the external device. The audio unit, the display part, and the controller may be located in a single body.

The foregoing and/or other aspects of the present general inventive concept may also be achieved by providing a display apparatus, including an audio unit having an audio signal processor to generate sound according to an audio signal received from an external device, a detector to detect the external device, and a controller to control a characteristic of the sound according to a determination of whether the detector detects the external device. The controller may control the sound characteristic by cutting off power to the audio unit when the detector does not detect the external device. The display apparatus may further include a power supply, and the controller may control the sound characteristic by controlling the power supply to cut off power to the audio unit when the detector does not detect the external device.

The foregoing and/or other aspects of the present general inventive concept may also be achieved by providing a display apparatus, including a display part having a processor to generate an image signal, a detector to detect an external device connected to the display part, and a controller to control a characteristic of the image signal according to a determination of whether the detector detects the external device.

The foregoing and/or other aspects of the present general inventive concept may also be achieved by providing a method of controlling a display apparatus including an audio signal processor and a controller, the method including detecting whether the display apparatus is connected to an external device, when the display apparatus is detected to be connected to the external device, providing power to the audio signal processor and controlling the controller to control the audio signal processor to control a volume of sound output from the display apparatus, and when the display apparatus is not detected to be connected to the external device, cutting off power to the audio signal processor and controlling the controller to control display conditions of an image displayed on the display apparatus.

BRIEF DESCRIPTION OF THE DRAWINGS

The above and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
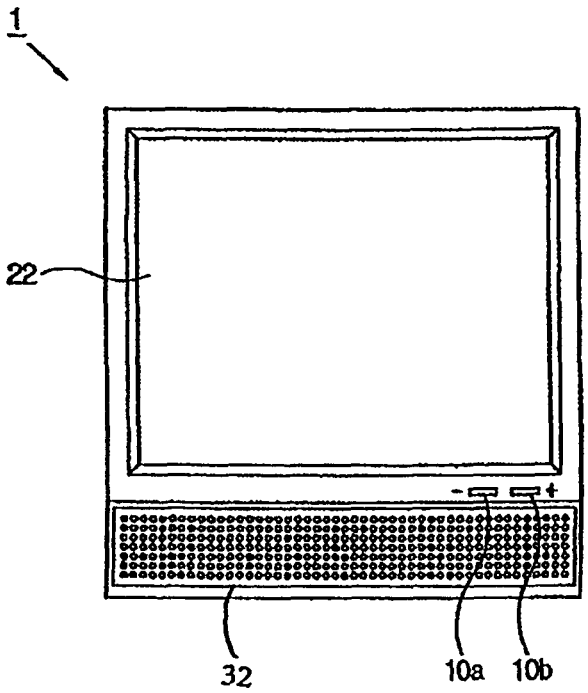
FIG. 1 illustrates a front view of a display apparatus according to an embodiment of the present general inventive concept.

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

Figure 2:
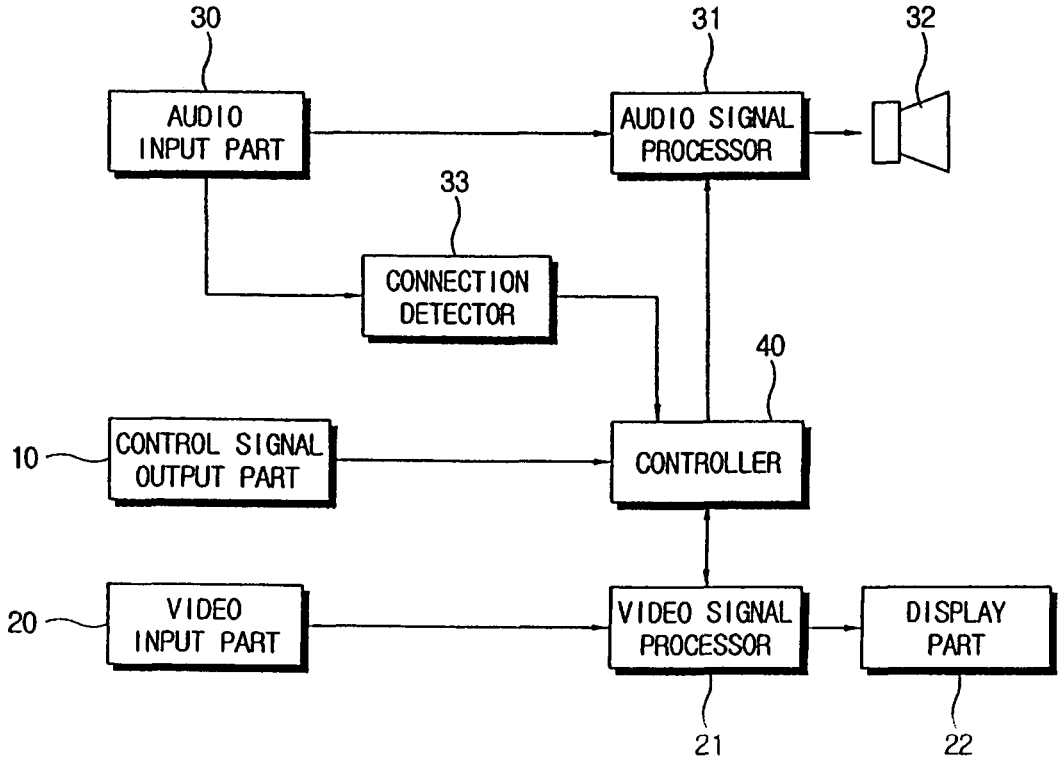
FIG. 2 illustrates a control block diagram of the display apparatus in FIG. 1.
Figure 3A:
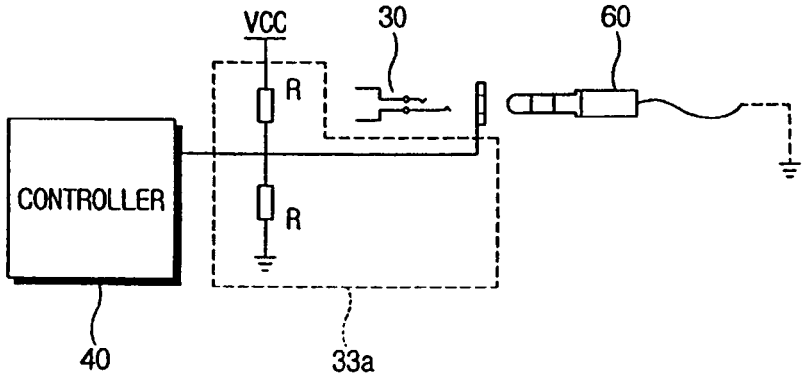
FIGS. 3A-4B illustrate a connection detector of the display apparatus in FIG. 2.
Figure 3B:
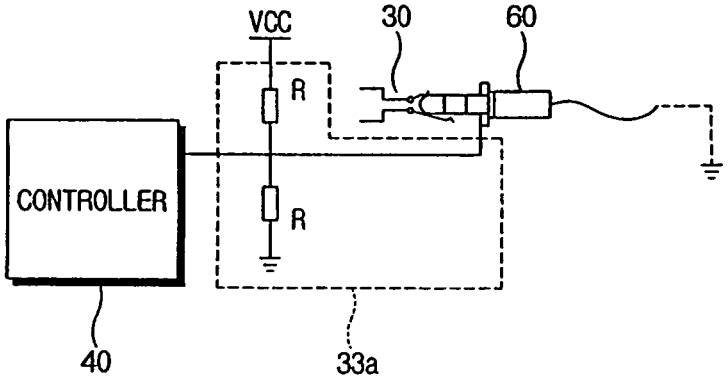
Figure 4A:
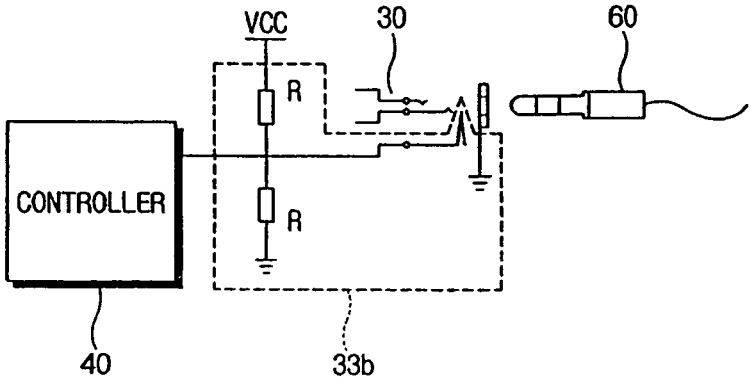
Figure 4B:
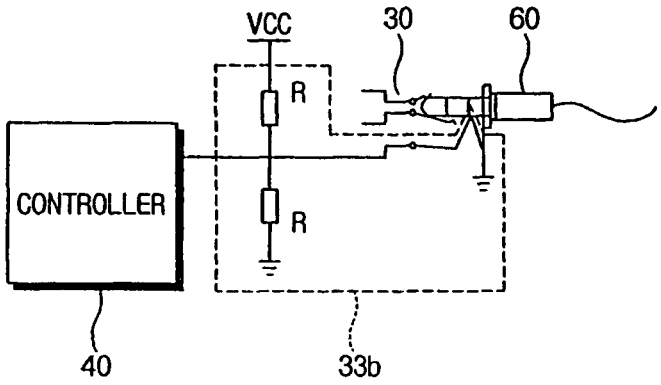

As illustrated in FIGS. 1 and 2, a display apparatus 1 comprises a display part 22 to display an image thereon, a video input part 20 to receive a video signal, a video signal processor 21 to convert the video signal input from the video input part 20 into an image signal displayable by the display part 22, and a controller 40 to control operations of the display part 22, the video imput part 20, and the video signal processor 21.

The display part 22 receives the image signal converted by the video signal processor 21 to display the image signal as the image thereon. Here, the display part 22 may comprise one of cathode ray tubes (CRTs), liquid crystal displays (LCDs), plasma display panels (PDPs). Also, the display part 22 may be provided as other display types to display the image thereon.

The video signal processor 21 converts the video signal received through the video input part 20 into the image signal displayable by the display part 22 as the image to output the image signal to the display part 22.

Here, the video signal processor 21 may comprise various configurations according to a signal format of the video signal received through the video input part 20 and/or according to a type of the display part 22. For example, the video signal processor 21 may comprise a signal converter having a scaler to scale the video signal received through the video input part 20 and to convert a vertical frequency, a resolution, a picture ratio, a brightness, etc., corresponding to output standards of the display part 22, an A/D (analog-to-digital) converter to convert the video signal received through the video input part 20 into a signal (e.g. into digital R, G and B signals) displayable by the scaler, a video decoder, a tuner, etc.

The video input part 20 may comprise various video connectors to receive the video signal output from an image source such as a computer. For example, the video input part 20 may comprise at least one of a D-Sub connector, a DVI connector, a composite terminal, a component terminal, and the like.

Meanwhile, as illustrated in FIGS. 1 and 2, the display apparatus 1 according to the embodiment of the present general inventive concept comprises a speaker 32, an audio signal processor 31, a connection detector 33, and a control signal output part 10.

As illustrated in FIG. 1, the speaker 32 is disposed on an external part of the display apparatus 1 to output sound. The speaker 32 is provided on a front lower part of the display apparatus 1 in FIG. 1 as an example of the present general inventive concept, but the position of the speaker 32 is not limited thereto.

An audio input part 30 receives an audio signal from an external device. Here, the audio input part 30 may be provided as audio input terminals to receive the audio signal from the external device. For example, the audio input terminals may comprise at least one of an audio output jack to transmit the audio signal output from the external device (e.g., a mini plug input terminal to connect with a mini plug 60 (see FIGS. 3A-4B) connected with the external device) or an audio composite terminal to connect with an audio composite jack connected with the external device. FIGS. 3A-4B illustrate an audio input terminal as the audio input part 30, along with the mini plug 60.

The audio signal processor 31 outputs the audio signal input from the audio input part 30 outside through the speaker 32. The audio signal processor 31 may comprise an audio amplifier to amplify the audio signal from the audio input part 30 to output the amplified audio signal to the speaker 32.

The display apparatus 1 may also include a detector to detect whether the audio signal is input through the audio input part 30. For example, a connection detector may be included to detect whether the external device is connected to the audio input part 30. The connection detector provides a detection result to a controller 40.

Here, the connection detector may detect whether the external device is connected to the audio input part 30 according to whether the audio output jack of the external device is inserted. FIGS. 3A-4B illustrate examples of connection detectors 33*a* and 33*b* to detect whether the external device is connected to the audio input part 30 according to the insertion of the audio output jack into the audio input part 30.

Referring to FIGS. 3A-4B, the connection detectors 33*a* and 33*b* may comprise a voltage divider resistor R to maintain a specified pin of the controller 40 at a high state by a detection power VCC in a state that the audio output jack is not connected to the audio input terminal. Here, the specified pin of the controller 40 is connected to a node between two voltage divider resistors R.

When the audio output jack is connected to the audio input terminal, the node between the two voltage divider resistors R is connected to the ground to convert the specified pin of the controller 40 into a low state. Accordingly, the controller 40 detects whether the external device is connected.

The control signal output part 10 outputs a predetermined control signal to the controller 40 according to a control input by a user. As illustrated in FIG. 1, the control signal output part 10 may comprise buttons 10*a* and 10*b*, which are disposed in an external part of the display apparatus 1. The control signal output part 10 may further comprise a remote controller, and a wireless receiver to apply the corresponding control signal to the controller 40 if a wireless signal is received from the remote controller.

Meanwhile, the controller 40 controls the volume of the speaker 32 according to the control signal from the control signal output part 10 in a state that the connection detectors 33*a* and 33*b* detect whether the external device is connected. That is, the controller 40 controls the audio signal processor 31 to control the volume of the speaker 32 corresponding to the control signal if the control signal is received from the control signal output part 10 in a state that the audio output jack is connected to the audio input part 30. Thus, the user may control the volume of the speaker 32 through the buttons 10*a* and 10*b* provided in the display apparatus 1 or through the remote controller if using the speaker 32 by connecting the audio output jack to the audio input part 30. Moreover, the user may control the volume by lowering the volume, by raising the volume, and by muting the volume. In addition, the user may control other sound characteristics instead of or in addition to the volume, such as a bass, a treble, a pitch, and an amplification of the sound.

Alternatively, the controller 40 may control display conditions of the image (e.g. a brightness level of the image) displayed on the display part 22 according to the control signal from the control signal output part 10 when a connection of the external device is not detected by the connection detectors 33*a* and 33*b*. That is, the controller 40 may control the brightness of the image displayed on the display part 22 corresponding to the control signal if the control signal is received from the control signal output part 10 in a state that the audio output jack is not connected to the audio input part 30. In addition, the user may control other display characteristics of the image instead of or in addition to the brightness, such as a vertical frequency, a resolution, and a picture ratio of the image. Thus, the user may use the control signal output part 10, such as the buttons 10*a* and 10*b* or the remote controller provided to control the volume of the speaker 32 for other purposes, if the user does not use the speaker 32 of the display apparatus 1 (i.e., if the audio output jack is released from the audio input part 30).

Figure 5:
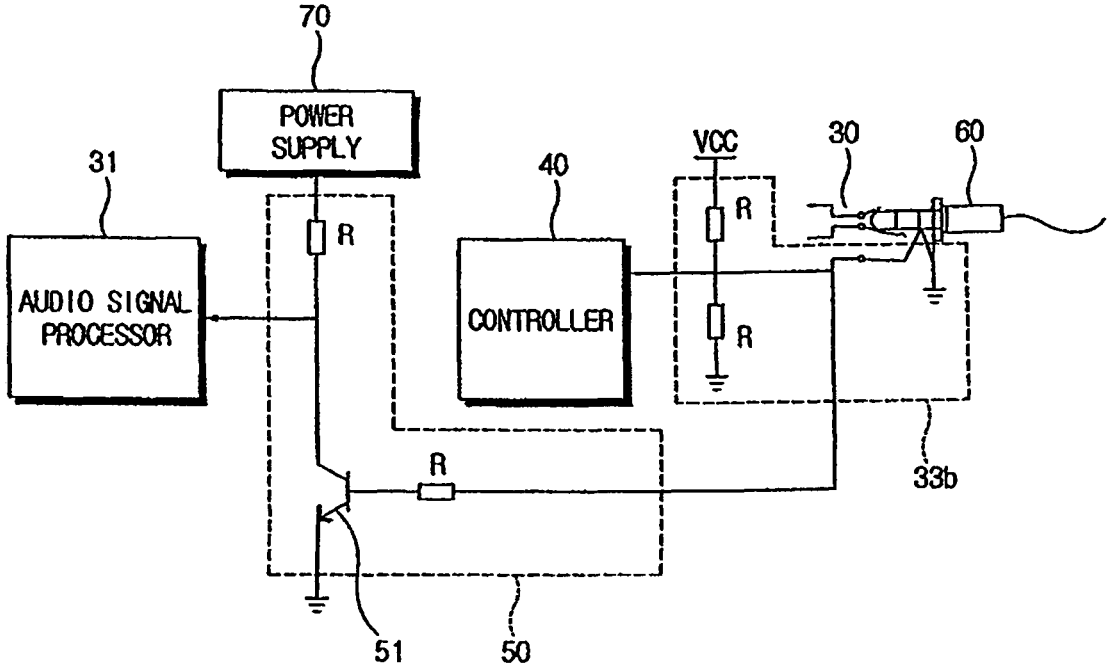
FIG. 5 illustrates a control block diagram of the display apparatus in FIG. 1.

As illustrated in FIG. 5, the display apparatus 1 according to an embodiment of the present general inventive concept may comprise a power supply 70 to supply power to the audio signal processor 31, and a power switch 50 to turn on and off the power supply 70.

Here, the power switch 50 is switched on to supply power to the audio signal processor 31 from the power supply 70 if the connection of the external device is detected by the connection detector 33*b*. Conversely, the power switch 50 is switched off to cut off power supplied to the audio signal processor 31 from the power supply 70 if the connection of the external device is not detected by the connection detector 33*b*. Thus, when the speaker 32 is not used and the audio input part 30 is not connected to the external device, the power supplied to the audio signal processor 31 is cut off, thereby preventing unnecessary power consumption.

Referring to FIG. 5, the power switch 50 may comprise a switching element 51 such as a transistor or an NPN transistor. A gate terminal of the switching element 51 is connected to the connection detector 33*b* through a second resistor R. A source terminal of the switching element 51 is connected to the power supply 70 and a drain terminal of the switching element 51 is connected to the ground, thereby turning on and off the audio signal processor 31 according to the detection result of the power detector.

The gate terminal of the switching element 51 is connected to the connection detector 33*b* to be switched on and off according to the detection result of the connection detector 33*b* in FIG. 5, as an example of the present general inventive concept. Also, the controller 40 may control the power switch 50 to be connected to the switching element 51 and to turn on and off the audio signal processor 31 according to the connection of the external device, which is detected by the connection detector 33*b*.

Figure 6:
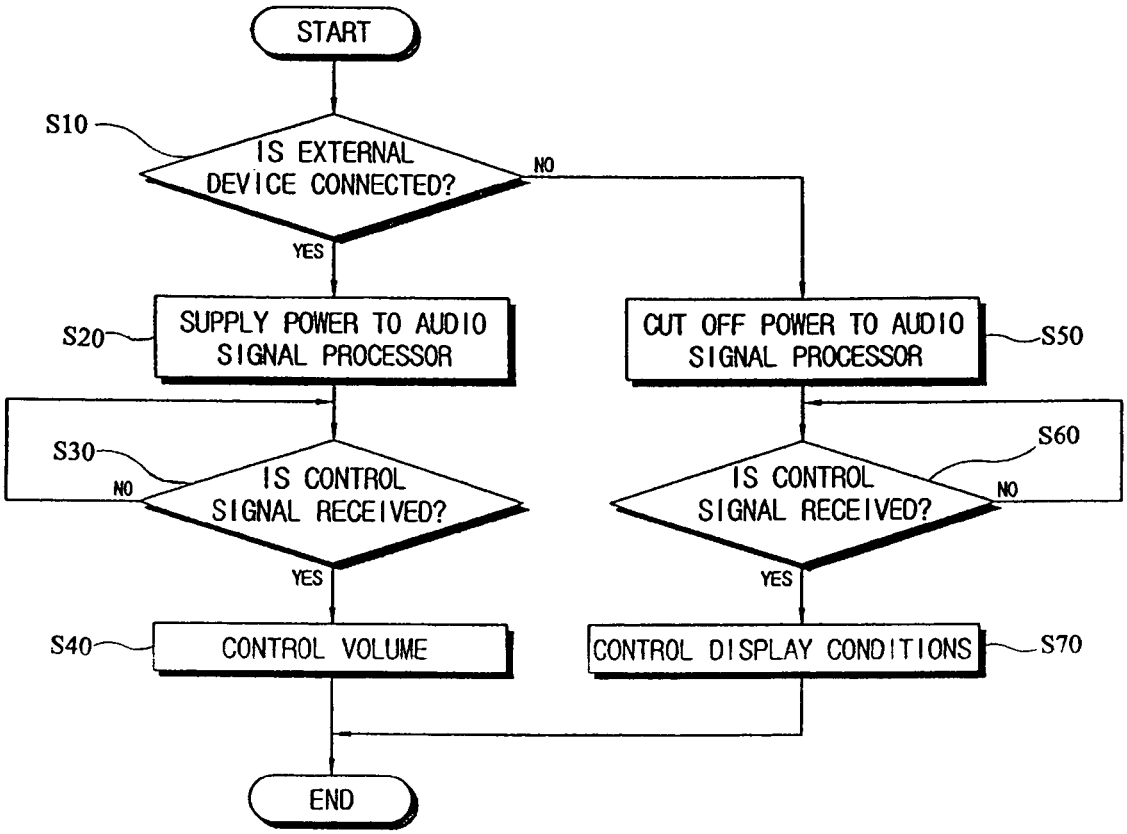
FIG. 6 illustrates a control flowchart of a display apparatus according to an embodiment of the present general inventive concept.

Hereafter, a control process of the display apparatus 1 according to the first embodiment of the present general inventive concept will be described with reference to FIG. 6 in view of FIGS. 1-5.

First, the connection detectors 33*a* and 33*b* detect whether the external device is connected at operation S10. If the connection of the external device is detected by the connection detectors 33*a* and 33*b*, the audio signal processor 31 receives power at operation S20. Here, a method of turning on and off the audio signal processor 31 is as described above.

If the control signal is received from the control signal output part 10 in a state that the audio signal processor 31 is supplied with power at operation S30, the controller 40 controls the audio signal processor 31 to control the volume of the speaker 32 according to the corresponding control signal at operation S40.

Conversely, if the connection detectors 33*a* and 33*b* detect that the external device is not connected at operation S10, the power supplied to the audio signal processor 31 is cut off at operation S50. If the control signal is received from the control signal output part 10 in a state that the audio signal processor 31 does not receive power at operation S60, the controller 40 controls the display conditions of the image (e.g., a brightness level of the image) displayed on the display part 22 according to the corresponding control signal at operation S70.

Hereafter, a display apparatus according to a second embodiment of the present general inventive concept will be described. Here, the display apparatus according to the second embodiment of the present general inventive concept may comprise a video input part 20, a video signal processor 21, an audio input part 30, an audio signal processor 31, a speaker 32, connection detectors 33*a* and 33*b*, and a control signal output part 10 corresponding to the display apparatus 1 according to the first embodiment of the present general inventive concept illustrated in FIGS. 1-4B.

Figure 7:
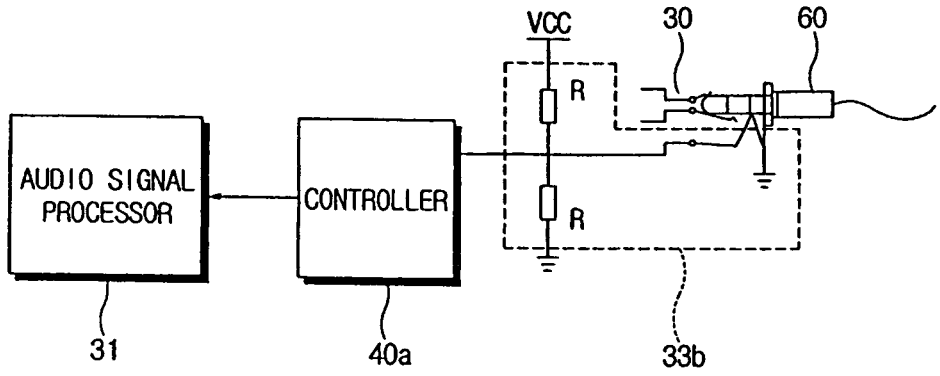
FIG. 7 illustrates a display apparatus according to an embodiment of the present general inventive concept.

As illustrated in FIG. 7, the audio signal processor 31 of the display apparatus 1 according to the second embodiment of the present general inventive concept receives power from a controller 40*a* to drive itself. That is, even though the power supply 70 and the power switch 50 operate as an audio power manager to turn on and off the audio signal processor 31 in the first embodiment of the present general inventive concept as illustrated in FIG. 5, the controller 40*a* operates as the audio power manager in the second embodiment of the present general inventive concept.

The controller 40*a* supplies power to the audio signal processor 31 if the connection of an external device is detected by the connection detector 33*b*. Conversely, the controller 40*a* cuts off power supplied to the audio signal processor 31 if the connection of the external device is not detected by the connection detector 33*b*. Thus, unnecessary power consumption may be prevented by cutting off power supplied to the audio signal processor 31 when the speaker 32 is not in use because the external device is not connected to the audio input part 30.

In some embodiments of the present general inventive concept, the utilization of a control signal from a control signal output part can be controlled by a detection result of connection detectors, together with a power supply, to an audio signal processor. In other embodiments of the present general inventive concept, a power supply to an audio signal processor can be controlled by a detection result of connection detectors, independent from the utilization of a control signal.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A display apparatus, comprising:

an audio signal processor to process an audio signal;

a video signal processor to process a video signal;

a connection detector to detect a connection of an external audio source to the display apparatus; and a controller configured to control the audio signal processor to change a volume of the audio signal according to an input from a control key from a user when the connection detector detects that an external audio source is connected to the display apparatus and configured to control the video signal processor to change a characteristic of the video signal according to an input from the control key from the user when the connection detector detects that the external audio source is not connected to the display apparatus.

2. The display apparatus according to claim 1, wherein the characteristic of the video signal includes at least one of a vertical frequency, a resolution, a picture ratio, and a brightness of the video signal.

3. The display apparatus according to claim 1, further comprising:

a power switch to selectively apply power to the audio signal processor by cutting off power to the audio signal processor when an external audio source is not connected to the display apparatus.

4. A method of controlling a display apparatus, the method comprising:

detecting whether an external audio device is connected to the display apparatus;

receiving an input from a control key;

controlling an audio signal processor of the display apparatus to change a volume of an audio signal according to the input from a user when it is detected that the external audio device is connected to the display apparatus; and controlling a video signal processor of the display apparatus, to control a characteristic of a video signal according to the input from the user when it is detected that the external audio device is not connected to the display apparatus.

5. The method according to claim 4, wherein the characteristic of the video signal includes at least one of a vertical frequency, a resolution, a picture ratio, and a brightness of the video signal.

6. The method according to claim 4, further comprising:

selectively powering the audio signal processor when the external audio device is connected to the display apparatus.

7. The method according to claim 6, further comprising:

cutting off power to the audio signal processor when the external audio device is not connected to the display apparatus.

8. The method according to claim 4, wherein the detecting comprises:

generating a detection signal from a ground signal of the audio signal.

* * * * *